US006718653B1

(12) United States Patent
Sartorio

(10) Patent No.: US 6,718,653 B1
(45) Date of Patent: Apr. 13, 2004

(54) METHOD FOR PREVENTING OR CONTROLLING THE OCCURRENCE OF STAINS ON WOOD

(75) Inventor: Robert Cardoso Sartorio, Aracruz (BR)

(73) Assignee: Aracruz Celulose S.A., Rio de Janeiro (BR)

( * ) Notice: Subject to any disclaimer, the term of this patent is extended or adjusted under 35 U.S.C. 154(b) by 0 days.

(21) Appl. No.: 10/089,307

(22) PCT Filed: Oct. 27, 2000

(86) PCT No.: PCT/BR00/00119

§ 371 (c)(1),
(2), (4) Date: Aug. 8, 2002

(87) PCT Pub. No.: WO97/07373

PCT Pub. Date: Feb. 27, 1997

(30) Foreign Application Priority Data

Oct. 29, 1999 (BR) ..... 9904982

(51) Int. Cl.[7] ..... F26B 7/00
(52) U.S. Cl. ..... 34/396; 34/391
(58) Field of Search ..... 34/396, 329, 337, 34/391

(56) References Cited

U.S. PATENT DOCUMENTS 1,953,193 A * 4/1934 Sampson ..... 34/396
3,678,595 A * 7/1972 Fagerstrom ..... 34/13.4
3,811,200 A * 5/1974 Hager ..... 34/9.5
4,017,980 A * 4/1977 Kleinguenther ..... 34/13.4
5,480,679 A 1/1996 Schmidt et al. ..... 427/254
5,678,324 A * 10/1997 Viitaniemi et al. ..... 34/396
5,836,086 A 11/1998 Elder ..... 34/396
5,858,484 A 1/1999 Amburgey et al. ..... 428/15
6,014,819 A 1/2000 Elder ..... 34/396
6,119,364 A 9/2000 Elder ..... 34/212
6,374,513 B1 * 4/2002 Unternhahrer et al. ..... 34/396

FOREIGN PATENT DOCUMENTS

WO WO 97/07373 2/1997

OTHER PUBLICATIONS

"Oxidizing Enzymes and their Relation to Sap Stain in Lumber" by Irving W. Bailey, published in vol. 50 of the "Botanical Gazette of 1910", pp. 142–147.

* cited by examiner

*Primary Examiner*—Kenneth Rinehart
(74) *Attorney, Agent, or Firm*—Smith, Gambrell & Russell LLP

(57) ABSTRACT

The present invention refers to a method for treating wood in order to prevent or control the occurrence of stains such as sapwood stains, the method comprising a step of heating green wood in a moisture-saturated environment until the wood core temperature is in a range of about 60 degrees C. to 95 degrees C., followed by a step of gradually cooling the wood, wherein the wood is maintained in an environment with moisture contents ranging from 95% to 100% during said cooling step.

11 Claims, No Drawings

METHOD FOR PREVENTING OR CONTROLLING THE OCCURRENCE OF STAINS ON WOOD

FIELD OF THE INVENTION

The present invention refers to a method for treating wood in order to prevent or to control the occurrence of stains thereon. The invention is particularly directed to a treatment for preventing the occurrence of sapwood stains.

BACKGROUND OF THE INVENTION

After wood has been cut from the trees it remains exposed to a process of decomposition and deterioration. For the industry, and especially for the furniture and civil construction industries, one of the most relevant and undesirable consequences of wood deterioration is the occurrence of stains and cracks that, together with the presence of knots and other visible defects, impair its occurrence and, as a result, makes it difficult to use that wood for those specific purposes.

There are many factors responsible for wood deterioration, namely: physical, chemical and biological factors. Among the biological factors one can mention the bacteria or fungi challenges that may be prevented or treated by impregnating the wood with biocides. But there is also the biological deterioration caused by non-microbial factors such as enzymatic reactions and that also leads to the occurrence of stains on wood.

For example, wood that comes from many species of trees develops ash-colored stains, caused by enzymatic reactions and that are called "sapwood stains". Although the origin of such stains is not accurately understood, it is known that as the cells of the wood parenchyma die, they produce enzymes that oxidizes and generally become ash-colored. The stain intensity and extension vary according to each different specie of wood (tree). This kind of stain is described in the technical literature with respect to species such as red oak, sugar hackberry (*Celtis laevigata*), flowering ash (Fraxinus spp.), yellow-poplar (*Liriodentron tuipifera L.*), among others. In the case of the eucalyptus species, for example, by effecting a cross section on the wood it is possible to observe the occurrence of a sapwood stain which develops from the transition region between the core and the sapwood (also called "alburnum") until it spreads all over the sapwood portion. Usually, after eucalyptus wood boards have been cut and planed, they present ash-colored stains which makes it very difficult and inappropriate to use them for end products that are supposed to be later used with an apparent finishing.

Various methods have been developed to prevent the occurrence of enzymatic origin stains on wood. For example, methods according to which wood is subjected to thermal treatment are already known, which methods may be carried out by means of vapors (steaming), microwaves or by dipping the wood into hot water. In this regard, article "Oxidizing Enzymes and their Relation to Sap Stain in Lumber", published in the "Botanical Gazette of 1910, already described a preventive treatment that comprises dipping wood into boiling water (100° C.) for a few minutes. According to that document, the immersion in water prevents the occurrence of stains, However, in order to ensure that no stain would occur the thus treated wood should be cooled under covering so as to avoid its exposition to light.

The use of chemical compounds for treating wood in an attempt to avoid the occurrence of unwanted stains is also known from prior art. Chemical compounds such as sodium methabisulfite, bromide, ammonia, among others, are described as being suitable for killing the cells of the parenchyma in a controlled way or for preventing the oxidation process, thus avoiding the formation of stains. An example of a process using chemical compounds for this purpose is described in U.S. Pat. No. 5,480,679.

Other methods described for preventing stains on logs comprise the application of mechanical force, like the method described in U.S. Pat. No. 5,858,484, according to which a mechanical force such as compression and vibration is to the wood for some time and with an intensity sufficient to produce or eliminate the stain.

However, all methods already known from the prior art present undesirable side effects such as, for example, the formation of dark stripes as the ones that result from the sodium methabisulfite treatment, or the occurrence of surface cracks on wood that is treated by steaming or by merely dipping it into hot water, which equally disqualifies that wood for determined and specific end uses, apart from involving considerable high costs.

In addition, methods that comprise treating wood with chemical compounds have the further disadvantage that many of those compounds are toxic or, at least, generate very bad smell, which causes a serious discomfort to the technicians involved and to the persons who work close to the wood treatment station.

Therefore, the objective of the present invention is to provide an efficient and inexpensive method for the treatment of wood with a view to preventing or controlling the occurrence of stains thereon and that will integrally preserve its structure, without causing cracks or any other defects on the wood.

SUMMARY OF THE INVENTION

The present invention refers to a method for treating wood to prevent or control the occurrence of stains, which comprises a step of heating the green wood in a moisture-saturated environment until the temperature of the wood core is in a range of about 60° C.–95° C., followed by a step of gradually cooling the wood. During the cooling step, the wood is maintained in an environment having a moisture content in the range from 95% to 100%.

DETAILED DESCRIPTION OF THE INVENTION

The inventors have found that it is possible to avoid or decrease considerably the occurrence of stains on wood, mainly enzyme-originated stains (sapwood stains), by a thermal treatment comprising the steps of controlled heating and cooling wood in an atmosphere with specific moisture contents, which provides the conditions required to prevent the formation of cracks and other undesirable side-effects on the wood.

According to the method of the invention, green wood, which may be cut into logs or boards, is subjected to a heating step in a moisture-saturated atmosphere. The saturation during the heating should be total, that is to say, the moisture contents in the environment in which the wood is heated should be of 100%. According a preferred embodiment of the invention, the heating step is carried out by dipping the wood into a hat water bath, which ensures the required moisture environment.

The high heating temperature causes the death of the wood parenchyma cells, thus preventing the activity of these cells and the consequent process of enzymatic oxidation that would form the stains, while the saturation of the environment prevents the formation of surface cracks.

The heating temperature should be sufficient for the wood core to reach a range of about 60 to 95° C., preferably about 85° C. For this reason, and as it can be promptly verified by any person skilled in the art, the temperature in the heating environment as well as the necessary time for the wood to be maintained therein will depend upon various factors, such as the thickness of the logs or boards to be treated, their density, among others. The essential aspect, however, is that the temperature and the time are established in such a way that the heating of the core region can reach the above-mentioned temperature range.

After the heating step, wood is then left to cool in an environment that preserves its moisture contents within a range of from 95 to 100%. It is necessary that the cooling step is carried out in this way in order to achieve the desired results, so that the moisture on the wood surface will not be lost after the heating; otherwise, the possibility of occurrence of surface cracks increases due to the internal and superficial moisture gradient that is generated. It must be observed that that occurrence of cracks may be potentialized in function of numberless other factors such as the predisposition of the material to form cracks caused by growth stress, inadequate cutting of the logs into planks, among others. However, even in these cases the formation of cracks is substantially reduced by the process of the invention.

Preferably, the cooling step is carried out by covering the heated material with a moisture-impermeable material. This is a simple way of ensuring that the cooling takes place by maintaining the required level of moisture. However, the cooling may be carried out in any way that guarantees the maintenance of the moisture within the desired range, that is to say, that prevents the rapid loss of moisture from the wood surface to the environment. Examples of means and procedures suitable to be used in the cooling step include, for instance, cooling tunnels or dipping wood into water. In a preferred way, the treated wood is only exposed to the ambient air after it has been cooled until the wood core temperature reaches a value of about 45° C. or is within a range of from 10° C. to 20° C. above room temperature, which will depend upon the treated species and the place (environment), in order to prevent a thermal shock and its consequences.

The presently claimed method also presents additional advantages, since it can be used in association with other methods in which preservatives such as borates are employed, besides alleviating the growth stress in the treated boards or logs.

The method of the present invention is suitable for preventing or controlling the occurrence of stains of enzymatic origin on various species of wood, such as species of the genus Eucalyptus, the use of which has recently been increasing on the market of furniture production as well as for other applications where an "apparent" (visual) form is required, in which case the prevention of wood discoloration and deterioration is of extreme relevance.

The illustrative example given below will serve to describe the present invention in a better and more precise way. However, the data and procedures illustrated therein merely refer to some embodiments of the present invention and should not be take as being limitative of the scope thereof.

EXAMPLE

Boards of green wood being 32 mm thick and with at least one sapwood face were dipped into a tank filled with water preheated up to 95° C. five days after they had been cut. During the immersion step, the wood core temperature was measured until it reached about 85° C., which happened after 15 minutes from the beginning of the procedure.

The material was removed from the hot water bath and then stacked and immediately covered with a moisture-impermeable canvas. The operation of removing the material from the bath and covering the stack took about 5 minutes. The pile of wood was left to cool naturally, the temperature of the boards core being monitored. When that temperature reached 45° C., the covering was removed, and the wood was stacked in the open air, according to usual procedures. After a period of drying in open air and further drying in an oven until the moisture had reached 10%, the boards were then planed at their different faces and evaluated. No sapwood stain was detected.

What is claimed is:

1. A method for preventing or controlling the occurrence of stains on wood comprising a step of heating green wood in a moisture-saturated environment until the wood core temperature is in a range of from 60° C. to 95° C., followed by a step of gradually cooling the wood, wherein the wood is maintained in an environment with moisture contents ranging from about 95% to 100% during said cooling step.

2. A method according to claim 1, wherein the heating step is carried out in a hot water bath.

3. A method according to claim 1, wherein the heating step is carried out until the wood core temperature reaches about 85° C.

4. A method according to claim 1, wherein the cooling step is carried out until the wood core temperature reaches a value in the range of from 10 to 20° C. above room temperature.

5. A method according to claim 1, wherein said wood is selected from the species of the genus Eucalyptus.

6. A method according to claim 2, wherein the heating step is carried out until the wood core temperature reaches about 85° C.

7. A method according to claim 2, wherein the cooling step is carried out until the wood core temperature reaches a value in the range of from 10 to 20° C. above room temperature.

8. A method according to claim 3, wherein the cooling step is carried out until the wood core temperature reaches a value in the range of from 10 to 20° C. above room temperature.

9. A method according to claim 2, wherein said wood is selected from the species of the genus Eucalyptus.

10. A method according to claim 3, wherein said wood is selected from the species of the genus Eucalyptus.

11. A method according to claim 4, wherein said wood is selected from the species of the genus Eucalyptus.

* * * * *